US005095866A

United States Patent [19]

Burke

[11] Patent Number: 5,095,866

[45] Date of Patent: Mar. 17, 1992

[54] STARTING FLUID CANISTER HEATER

[75] Inventor: James O. Burke, Crystal Lake, Ill.

[73] Assignee: Kold Ban International, Lake-in-the-Hills, Ill.

[21] Appl. No.: 699,812

[22] Filed: Apr. 26, 1991

[51] Int. Cl.[5] ..... F02M 1/16

[52] U.S. Cl. ..... 123/179.14; 123/179 H; 123/549; 123/179.21; 123/179.15

[58] Field of Search ..... 123/180 E, 180 T, 180 AC, 123/187.5 R, 179 H, 549

[56] References Cited

U.S. PATENT DOCUMENTS

| | | | |
|---|---|---|---|
| 1,454,929 | 5/1923 | Irwin | 123/187.5 R |
| 1,456,018 | 5/1923 | Wiegand | 123/549 |
| 2,851,027 | 9/1958 | Kivela | 123/187.5 |
| 3,190,277 | 6/1965 | Tessier | 123/187.5 R |
| 3,259,119 | 7/1966 | Kivela | 123/187.5 |
| 3,448,733 | 6/1969 | Aske | 123/180 |
| 4,202,309 | 5/1980 | Burke | 123/180 R |
| 4,326,485 | 4/1982 | Burke | 123/180 AC |
| 4,346,683 | 8/1982 | Burke | 123/180 R |
| 4,383,507 | 5/1983 | Powell | 123/179 H |
| 4,387,676 | 6/1983 | Couceiro | 123/179 H |
| 4,667,645 | 5/1987 | Gluckman | 123/552 |
| 4,876,989 | 10/1989 | Karpuk et al. | 123/3 |

FOREIGN PATENT DOCUMENTS

| | | | |
|---|---|---|---|
| 220523 | 8/1924 | United Kingdom | 123/180 E |

OTHER PUBLICATIONS

Hotwatt and Acra advertising.

*Primary Examiner*—Andrew M. Dolinar
*Attorney, Agent, or Firm*—Willian Brinks Olds Hofer Gilson & Lione

[57] ABSTRACT

A starting fluid injection system includes a pressurized canister containing a starting fluid under pressure which is dispensed by a valve to an internal combustion engine. A heating element is mounted on the canister, and a power circuit supplies power to the heating element. A thermostat is included in the power circuit to prevent the heating element from heating the canister when a measured control temperature, which may for example correspond to a surface temperature of the canister, is greater than a threshold value.

11 Claims, 1 Drawing Sheet

STARTING FLUID CANISTER HEATER

BACKGROUND OF THE INVENTION

This invention relates to a starting fluid injection system that provides improved low temperature operation.

Starting fluid injection systems are widely used to improve the cold starting characteristics of internal combustion engines. U.S. Pat. Nos. 4,202,309, 4,326,485 and 4,346,683 (assigned to the assignee of the present invention) disclose several such prior art systems. Typically, a starting fluid is contained in a pressurized canister that is coupled to a valve. The valve is electrically controlled to release starting fluid from the canister on command, and the released starting fluid is injected into the induction system of the internal combustion engine to be started.

Problems have arisen with such systems at extremely low ambient temperatures. For example, at ambient temperatures as low as −40° F. the pressure of the starting fluid within the canister can fall to such low value, that there is insufficient pressure in the canister to inject an adequate amount of starting fluid into the internal combustion engine.

It is an object of this invention to provide improved operation to a starting fluid injection system at extremely low temperatures.

SUMMARY OF THE INVENTION

This invention relates to a starting fluid injection system for an internal combustion engine, of the general type described above. According to this invention, a heating element is coupled to the canister and a power circuit is coupled to the heating element to cause the heating element to heat the canister. A thermostat is included in the power circuit to prevent the heating element from heating the canister when a measured control temperature is greater than a first threshold value.

By heating the pressurized canister at low temperatures, the pressure within the canister is thereby increased. This has been found to enhance operation of the starting fluid injection system at temperatures as low as −40° F., and to improve the reliability with which the internal combustion engine can be started.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 2:
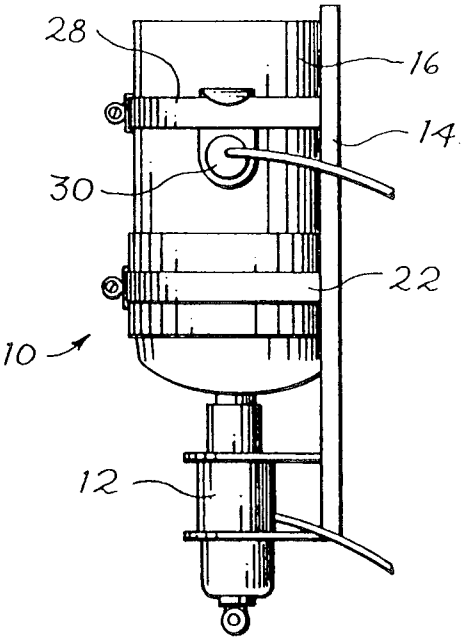
FIG. 2 is a side elevational view of the components of FIG. 1.
Figure 1:
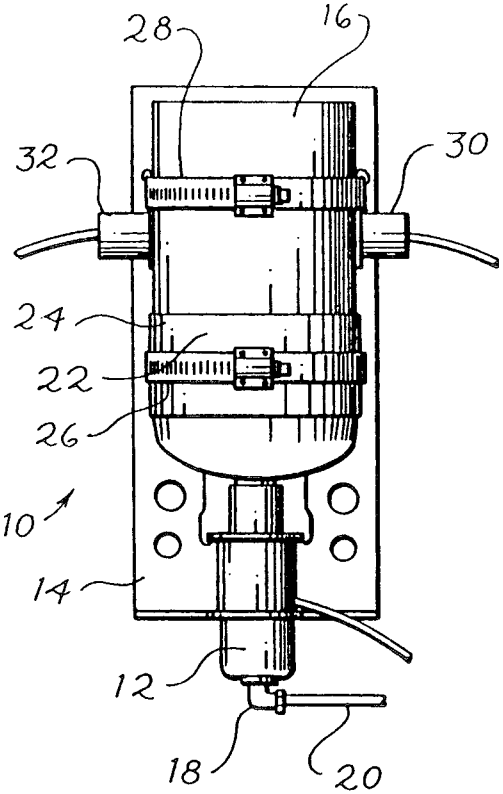
FIG. 1 is a front elevational view of portions of a starting fluid injection system which incorporates a presently preferred embodiment of this invention.

Turning now to the drawings, FIGS. 1 and 2 show front and side elevational views respectively of a starting fluid injection system 10 which incorporates the presently preferred embodiment of this invention. The system 10 includes a valve 12 which may be a conventional solenoid valve of the type shown for example in the above-identified U.S. Patents. The valve 12 is mounted to a plate 14, and a canister 16 is secured to the valve 12. The canister 16 contains a quantity of starting fluid under pressure. The valve 12 includes an outlet port 18 which is coupled via a conduit 20 to the intake manifold of an internal combustion engine (not shown). In use, when the valve 12 is commanded open, it releases starting fluid under pressure from the canister 16 to the conduit 20, and via the conduit 20 to the internal combustion engine as a starting aid. The conduit 20 can be considered as part of the means for supplying starting fluid released by the valve !2 to the engine (not shown).

The foregoing components of the system 10 are conventional in the art and have been described merely to define the environment of the present invention. A wide variety of canisters, valves and starting fluid injection devices may be substituted for the examples illustrated.

According to this invention, a heating element 22 is secured in a releasable manner to an exterior surface of the canister 16 In this embodiment the heating element 22 is an electrical resistance heater sealed in a silicone rubber sheet, and the heating element 22 is flexible so that it can be wrapped around the perimeter of the canister 16. The heating element 22 is covered with a protective metal sheet 24 that can for example be formed of brass. The sheet 24 protects the heating element 22 from physical injury. The sheet 24 and the heating element 22 are releasably held in place on the canister 16 by a clamp 26, which may for example be a hose clamp of the type illustrated.

Additionally, a second clamp 28 (which may be identical to the first clamp 26), is also mounted around the canister 16, vertically upwardly from the clamp 26. The clamp 28 releasably secures two temperature sensors 30, 32 in thermal contact with the canister 16. In this embodiment the temperature sensor 30 includes a temperature sensitive switch designed to close at temperatures at or below 23° F. and to open at temperatures at or above 38° F. As explained below, the temperature sensor 30 is used as a thermostat to control the operation of the heating element 22. The temperature sensor 32 includes a second temperature sensitive switch that is designed to close at temperatures below 75° F., and to open at temperatures above that level. As explained below, the temperature sensor 32 is used as a safety switch to prevent excessive heating of the canister 16. As best shown in FIG. 2 the temperature sensors 30 and 32 include tabs which fit under the clamp 28 to capture the temperature sensors 30, 32 in place against the side wall of the canister 16.

Figure 3:
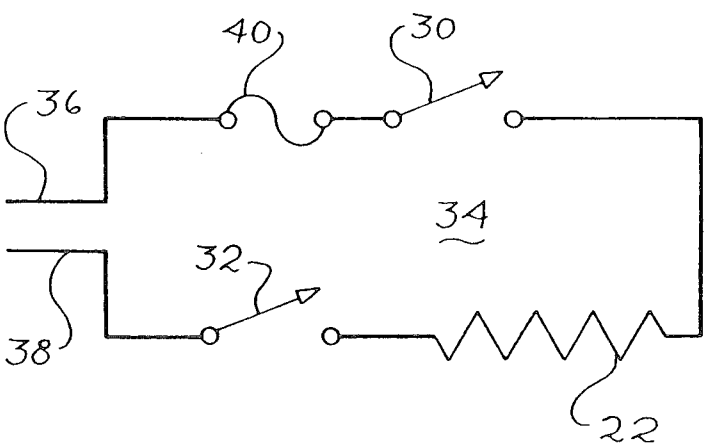
FIG. 3 is a schematic electrical diagram of a power circuit used with the embodiment of FIGS. 1 and 2.

FIG. 3 shows a schematic diagram of a power circuit 34 that can be used to control the operation of the heating element 22. The power circuit includes terminals 36, 38 designed to be attached to a power source such as a 120 volt AC power source. In the power circuit 34 the temperature sensors 30, 32 and the heating element 22 are connected in series as shown. Additionally, a fuse 40 is connected in series between the temperature sensor 30 and the terminal 36.

In use the temperature sensor 30 operates as a thermostat to ensure that the heating element 22 remains unpowered until the canister temperature falls below a selected threshold value (23° F. in this example). At that point the temperature sensor 30 closes the power circuit 34 and current is passed through the heating element 22. At temperatures below 23° F. the second temperature sensor 32 which operates as a safety over temperature switch is also closed.

The heating element 22 continues to heat the canister 16 until the temperature of the canister as measured by the temperature sensor 30 rises sufficiently to open the temperature sensor 30. This opening temperature is 38° F. in this example. Thus, the temperature sensor 30 operates as a thermostat to control the heating element 22 to maintain the temperature of the canister as measured at the temperature sensor 30 to heat the canister at low temperatures.

In the event that the temperature sensor 30 fails in a closed circuit condition, the heating element 22 will continue to heat the canister 16. In order to avoid excessively high temperatures of the canister 16, the second temperature sensor 32 automatically opens at 75° F. in this example.

The disclosed system has been found to elevate the temperature of the canister 16 relatively rapidly. For example, when the heating element 22 has a power rating of 100 watts, a canister at −40° F. will be brought to a surface temperature of 38° F. as measured at the temperature sensor 30 in approximately 30 minutes. Because the temperature sensor 30 is located on the surface of the canister 16 at a distance removed from the heating element 22, the temperature sensor 30 permits the surface temperature of the heating element 22 to rise to a level considerably higher than the switching point of the thermostat formed by the temperature sensor 30. This in turn increases the rate of heat transfer from the heating element 22 to the canister 16. By locating the heating element 22 at the bottom of the canister 16, heat transfer is enhanced because liquid starting fluid is typically located at the bottom of the canister 16. The remote location of the temperature sensor 30 near the top of the canister 16 more accurately reflects the temperature of the starting fluid contained in the canister than would a thermostat located near the heating element 22.

In order to define the presently preferred embodiment of this invention in greater detail the following details of construction are provided. It should be clearly understood however that these details of construction are intended only by way of illustration. In this embodiment the temperature sensor 30 is preferably of the type distributed by KBI (Algonquin, Ill.) as Part No. 300816. This temperature sensor includes a thermally responsive switch having a current rating at 12 volts DC of 14.5 amps. The temperature sensing component of the sensor can for example be of the type distributed by Therm-O-Disc as Part No. 11675, or by Hamilton Standard as Part No. 430-1367. Similarly, the temperature sensor 32 is preferably of the type distributed by KBI as Part No. 300803, which has a current rating of 14.5 amps at 12 volts DC. By way of example, this temperature sensor can include a sensing element such as the part sold by Therm-O-Disc as Part No. 11657 or by Hamilton Standard as Part No. 430-1279. The heating element 22 is preferably rated at 100 watts and is designed to operate at 120 volts. Suitable heating elements can be obtained from WATLOW Electric Co. (Saint Louis, Mo.) as Part No. 020-100-109. Of course, the heating element 22 may be selected to operate at other voltages, such as 24 volts DC for example. The clamps 26, 28 allow the heating element 22 and the sensors 30, 32 to be removed from one canister and applied to another after the first canister is exhausted. In this way the unnecessary replacement of component parts is eliminated.

Of course, a wide range of changes and modifications can be made to the preferred embodiment described above. Other types of clamps and affixing devices can be used, and in some applications it may be preferable to permanently affix either the temperature sensors 30, 32 or the heating element 22 to the canister 16. This invention can be adapted to a range of canisters 16 including aerosol canisters, and other types of heaters can be substituted for the resistive heater described above.

It is therefore intended that the foregoing detailed description be regarded as illustrative rather than limiting, and that it be understood that it is the following claims, including all equivalents, which are intended to define the scope of this invention.

I claim:

1. In a starting fluid injection system for an internal combustion engine, wherein said system comprises a pressurized canister containing a starting fluid under pressure, a valve coupled to the canister to release starting fluid therefrom on command, and means for supplying starting fluid dispensed by the valve to an internal combustion engine, the improvement comprising:

a heating element mounted on the canister;

a power circuit coupled to the heating element to cause the heating element to heat the canister; and a thermostat coupled to the power circuit to prevent the heating element from heating the canister when a measured control temperature is greater than a first threshold value.

2. The invention of claim 1 further comprising a clamp for releasably mounting the heating element to the canister.

3. The invention of claim 1 wherein the thermostat comprises:

a temperature sensitive switch responsive to the control temperature; and means for holding the switch in thermal contact with the canister such that the switch is responsive to the temperature of the canister.

4. The invention of claim 3 wherein the heating element is mounted on the canister between the valve and the temperature sensitive switch.

5. The invention of claim 1 further comprising a safety switch coupled to the power circuit to prevent the heating element from heating the canister when the canister temperature is greater than a second threshold value, greater than the first threshold value.

6. The invention of claim 5 wherein the heating element is spaced axially along the length of the canister from both the temperature sensitive switch and the safety switch.

7. The invention of claim 6 wherein the heating element has a power rating of about 100 watts.

8. In a starting fluid injection system for an internal combustion engine, wherein said system comprises a pressurized canister containing a starting fluid under pressure, a valve coupled to the canister to release starting fluid therefrom on command, and means for supplying starting fluid dispensed by the valve to an internal combustion engine, the improvement comprising:

means for heating the canister;

a power circuit coupled to the heating means to power the heating means; and a thermostat included in the heating means to prevent the power circuit from powering the heating means when a measured control temperature indicative of canister temperature is greater than a first threshold value.

9. The invention of claim 8 further comprising means for releasably mounting the heating means and the thermostat to the canister.

10. In a starting fluid injection system for an internal combustion engine, wherein said system comprises a pressurized canister containing a starting fluid under pressure, a valve coupled to the canister to release starting fluid therefrom on command, and means of supplying starting fluid dispensed by the valve to an internal combustion engine, the improvement comprising:

first and second clamps, each configured to surround the canister;

first and second temperature responsive switches, each removably pressed into thermal contact with the canister by the first clamp;

a heating element removably pressed into thermal contact with the canister by the second clamp, said heating element separated from the temperature responsive switches and disposed between the temperature responsive switches and the valve; and a power circuit coupled to the heating element to cause the heating element to heat the canister;

said first temperature responsive switch included in the power circuit and operative as a thermostat to interrupt power to the heating element above a first temperature;

said second temperature responsive switch included in the power circuit and operative as an over temperature safety switch to interrupt power to the heating element in the event the first temperature responsive switch fails in a closed circuit condition.

11. The invention of claim 10 wherein the heating element has a power rating of about 100 watts.

* * * * *